US006382862B2

(12) United States Patent
Hayao et al.

(10) Patent No.: US 6,382,862 B2
(45) Date of Patent: May 7, 2002

(54) APPLICATION LIQUID RESERVOIR

(75) Inventors: Sakae Hayao, Yokohama; Kazuhiko Furukawa, Saukawa-machi, both of (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 0 days.

(21) Appl. No.: 09/874,268

(22) Filed: Jun. 6, 2001

(30) Foreign Application Priority Data

Jun. 8, 2000 (JP) ..... 2000-172169

(51) Int. Cl.[7] ..... B43K 5/18
(52) U.S. Cl. ..... 401/227; 401/223; 401/224
(58) Field of Search ..... 401/224, 223, 401/225, 227, 228, 229

(56) References Cited

U.S. PATENT DOCUMENTS 2,684,052 A * 7/1954 Rickmeyer ..... 401/223

FOREIGN PATENT DOCUMENTS

FR 1570203 * 6/1969 ..... 401/228

* cited by examiner

*Primary Examiner*—David J. Walczak
(74) *Attorney, Agent, or Firm*—Armstrong, Westerman & Hattori, LLP

(57) ABSTRACT

An application liquid reservoir (collector) reserves application liquid in the vicinity of an application liquid guide that is interposed between an application liquid cartridge and an applicator. The application liquid reservoir includes a cylinder having an inner hole to receive an ink guide and fins projecting from the cylinder. The fins stand parallel to each other and perpendicular to an axial direction of the inner hole at predetermined intervals, with annular application liquid reserving slots being defined between respective adjacent two fins such that the application liquid reserving slots are set to be narrower in part.

9 Claims, 3 Drawing Sheets

(a)

(b)

APPLICATION LIQUID RESERVOIR

BACKGROUND OF THE INVENTION

1. Field of the Invention

The present invention relates to an application liquid reservoir (collector) that is suitable when used for liquid applicators such as writing implements or makeup liquid applicators.

2. Description of the Related Art

Generally, writing implements such as a fountain pen is provided with an ink reservoir (collector) which temporarily reserves an ink overflowing from an ink storage tank by use of the flow under the capillary power therein in order to maintain the pressure in the said ink storage tank at a predetermined pressure and thus to prevent the outflow of the ink from a nib.

Conventionally adopted for this kind of collector are a cylinder, which is formed with an inner hole to receive an ink relay object therein and a collector that has a plurality of projecting fins (circular boards) provided at a periphery of said cylinder to define ink-reserving slots therebetween.

In such prior art collector, the whole structure is usually formed of synthetic resin and manufactured as an integrally formed product using a injection mold.

By the way, in this kind of collector, the width of the ink-reserving slots is determined on the basis of the head value (from an air displacement hole) of the ink, a surface tension of the ink, and a contact angle with the ink, etc.

Therefore, it is preferable to set the ink-reserving slots as narrow as possible in order to allow the collector to have a sufficient capillary power suitable for such a setting value, in other words, to improve the delivery response of the ink at the time of the pressure rise in the ink tank.

In the prior art collector, when the width of the ink-reserving slots is set at an excessively small size (0.2mm or less), the rigidity (durability) of the mold can fall to such an extent that it is unable to produce articles of excellent quality.

Furthermore, it has been found that if the width of the ink-reserving slots is set at the size of 0.2 mm or less, the production of stable collectors becomes difficult.

Therefore, it can be considered to set the depth of the ink-reserving slots (the radius of the fins) at a small size such that the required rigidity of the mold from being lost. In this case, however, the capacity of the ink-reserving slots becomes too small to such an extent that it is unable to hold a sufficient quantity of ink inside the ink-reserving slots.

For the reasons mentioned above, it has so far been requested to produce the collector which is capable of not only assuring the sufficient capillary power, but also making the depth of the application liquid (ink) reserving slots set at a sufficient size while inhibiting the fall of the rigidity of the mold.

SUMMARY OF THE INVENTION

The present invention is made to meet the requirements described above, it is an object of the present invention to provide a collector which will improve the delivery response of the application liquid to be admitted to the application reserving slots by an extremely simple construction which sets part of the depth of the application liquid reserving slots at a small size and produce articles of excellent quality and furthermore hold a sufficient quantity of the application liquid inside the application reserving slots.

An application reservoir (collector) that is made to achieve the object mentioned above is the application liquid reservoir, which reserves the application liquid in the vicinity of an application liquid guide that is interposed between an application liquid cartridge and an applicator member. Said application liquid reservoir comprises a cylinder formed with an inner hole to receive an ink guide and fins extending from said cylinder. By offering said fins of the application liquid reservoir in the form of a plurality of fins that stand parallel to each other and perpendicular to an axial direction of the inner hole at predetermined intervals, the annular application liquid reserving slots are defined between the respective two adjacent fins as mentioned above and said application liquid reserving slots are set to be narrower in part.

Because of the constitution described above, said application liquid reserving slots can be made to be narrower in part while the application liquid reserving slots can also be made deeper.

Therefore, it is able to inhibit the fall of the required rigidity of the mold from being lost and to increase the inner capacity of the application liquid reserving slots, thus enabling to produce articles of excellent quality, to hold a sufficient quantity of application liquid within the application reserving slots and to improve the delivery response of the application liquid.

In this connection, the application liquid referred to herein means not only the application liquid such as makeup liquid but also inks used for writing implements or printing apparatuses.

Here, it is desirable that the application liquid reservoir is composed of two reservoir elements, each element having the form of one half of an application liquid reservoir divided along a cross section containing the axis line of the inner hole.

By offering the application liquid reservoir composed of two reservoir elements in the form described above, the respective reservoir elements can be molded separately before the application liquid reservoir is made up by assembling these two halves together.

Furthermore, it is desirable to form notches in the respective fins of the application reservoir to define application liquid introduction slots, which introduce the application liquid into the application reserving slots.

In the manner stated above, the application liquid is introduced into the application liquid reserving slots by way of the application liquid introduction slots in the respective fins.

Furthermore, it is desirable to make protruding sections on both sides of the openings at the margins of the application liquid introduction slots such that the application liquid reserving slots become narrower in part.

Furthermore, it is desirable to form protruding sections such that the application liquid introduction slots are narrower in part.

Thus constructed, a greater capillary power is realized in the vicinity of the protruding sections formed within the application liquid introduction slots to such an extent that the delivery of the application liquid from the application liquid introduction slots to the application liquid reserving slots is smoothly performed.

Furthermore, it is desirable that the cylinder of the application liquid reservoir is formed with application liquid flow in/out ports communicating with the inner hole and the application liquid reserving slots.

In the manner as stated above, the application liquid is introduced from the application liquid guide into the application liquid reserving slots by way of the application liquid flow in/out ports.

Furthermore, it is desirable that the protruding sections are formed in the respective fins such that the application liquid flow in/out ports are blocked in part while said application liquid reserving slots become narrower in part.

Thus constructed, a larger capillary power is realized in the vicinity of the protruding sections in the application liquid flow in/ out ports to such an extent that the delivery of the application liquid from the application liquid flow in/ out ports to the application liquid reserving slots is smoothly performed.

DESCRIPTION OF THE PREFERRED EMBODIMENTS

First embodiment of a liquid application reservoir in accordance with the present invention will be described hereinafter in detail with reference to FIGS. 1(*a*) and 1(*b*) and FIG. 2.

Figure 1:
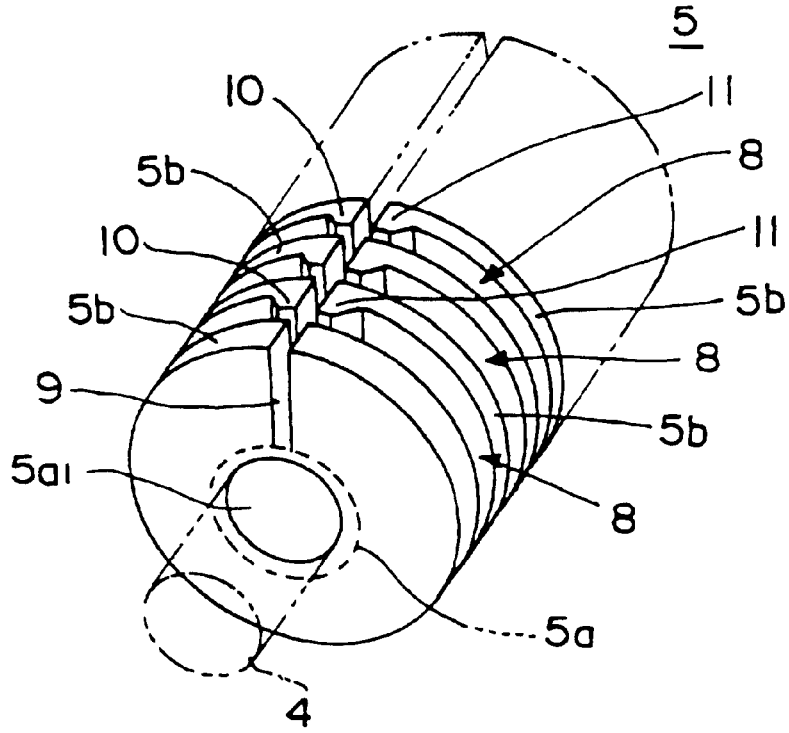
FIG. 1(*a*) and FIG. 1(*b*) are a perspective view and a front view illustrating a principal portion of a collector in accordance with a first embodiment of the present invention.
Figure 1:
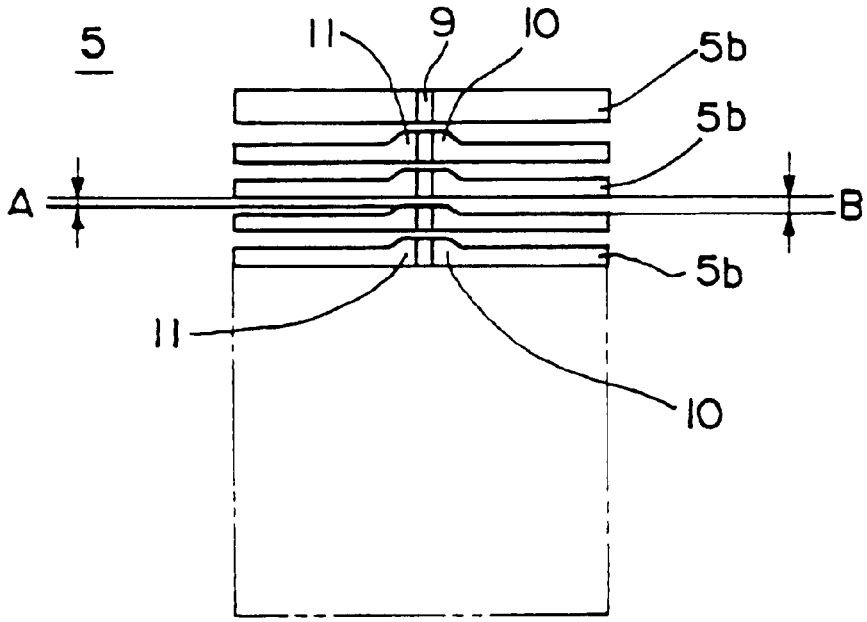
Figure 2:
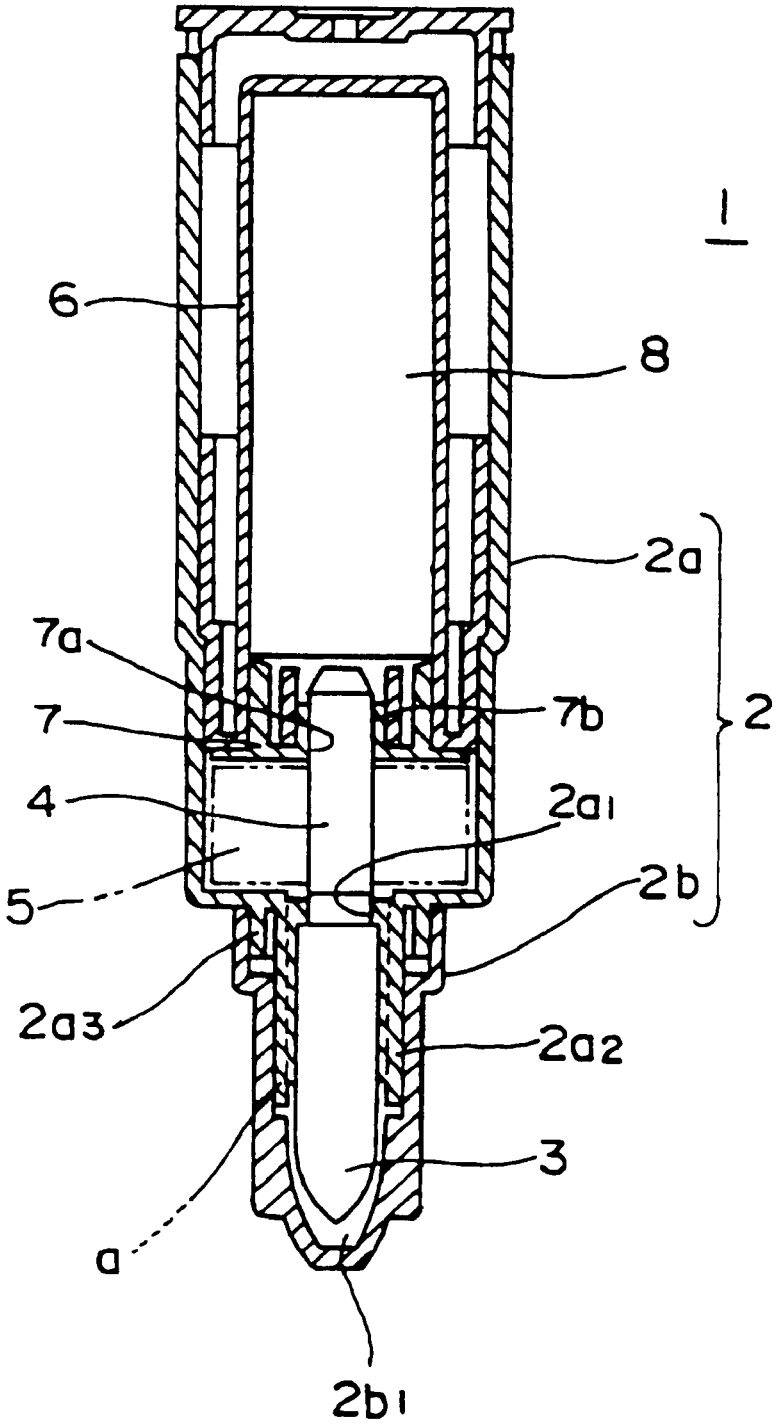
FIG. 2 is a cross-sectional view of an example of said collector being used to direct liquid type writing implements.

FIGS. 1(*a*) and 1(*b*) are a perspective view and a front view illustrating a principal portion of an application liquid reservoir (collector) in accordance with a first embodiment of the present invention, and FIG. 2 is a cross-sectional view of an example of the collector being adapted to a direct liquid type writing implements in accordance with a first embodiment of the present invention.

In FIG. 2, a writing implement 1 is comprised of a container 2, a pen core 3, an ink guide 4, and a collector 5.

Referring to FIG. 2, the container 2 is comprised of a container body 2*a* and a container lid 2*b*, said container 2 being generally made of for example a synthetic resin.

The container body 2*a* is formed with a stepped cylinder having a bottom at one end and a bore 2*a*1 opening in an axial direction such that an ink cartridge 6 is inserted therein to open in the same direction as the opening end of said bore 2*a*1. The container body 2*a* is integrally formed with two elastically deformable inside and outside standup sleeves 2*a*2 and 2*a*3 surrounding the open end of the bore 2*a*1 to extend outwardly. Said inside standup sleeve 2*a*2 is formed with a passage opening outwardly and inwardly of the container body 2*a* for air vent.

In addition, the open end of the ink cartridge 6 is loaded with a cartridge lid 7 formed with a bore 7*a* opening in an axial direction and having a standup sleeve 7*b*, which stands on the periphery of the opening on the cartridge side of said bore hole 7*a*.

Inside the ink cartridge 6, an ink impregnated object 8 such as a nonwoven fabric is loaded.

The container lid 2*b* is formed with a cylinder portion having a stepped top, which opens in an axial direction, said container lid 2*b* being detachably attached to said standup sleeves 2*a*2 and 2*a*3 of the container body 2*a*. Said container lid 2*b* is formed with an inner space 2*b*1 that is adapted to accommodate the pen core 3 therewithin. Thus constructed, the container lid 2*b* is attached to the container body 2*a* while not in use such that the pen core 3 is accommodated in the inner space 2*b*1.

The pen core 3 consists of an applicator made of a material such as felt, and said pen core 3 is coupled to the ink guide 4. In this state, said pen core 3 is loaded within the standup sleeves 2*a*2 of the container body 2*a*, said pen core 3 being generally substantially in the form of a cylinder having a pointed nib.

The ink guide 4 is interposed between the ink cartridge 6 and the pen core 3 such that said ink guide 4 is inserted to be secured by the bore 7*a* in the cartridge lid 7, the standup sleeve 7*b*, and the bore 2*a*1 of the container body 2*a*. Thereby, the ink inside the ink cartridge 6 is guided to the pen core 3 through the ink guide 4 at the time while the pen is in use.

The collector 5 is provided in the form of an ink reservoir, which reserves the ink in the vicinity of the ink guide 4, said collector 5 being accommodated inside the container body 2*a* and located between the container lid 7(on the pen core side and around the opening of the bore 7*a*) and the inner peripheral margin of the opening of the bore 2*a*1. Said collector 5 is comprised of a cylinder 5*a* and a plurality of fins 5*b* provided thereon, said collector being in general formed of synthetic resins such as an ABS resin.

As shown in FIG. 1, the cylinder 5*a* is located on the axis line of the ink guide 4. The cylinder 5*a* is formed with an inner hole 5*a*1, which opens to both sides of the axis line such that the ink guide 4 is inserted therethrough.

The fins 5*b* are in the form of plural annular pieces that stand parallel to each other and perpendicular to the axial direction at predetermined intervals therebetween, each fin being integrally formed on said cylinder 5*a* at a periphery thereof to extend radially outwardly therefrom. In these fins 5*b*, spaces are defined between respective two adjacent fins 5*b* and 5*b*, which serve as annular ink reserving slots 8 extending around the cylinder 5*a*.

By forming notches in the respective fins 5*b*, ink introduction slots 9 are defined to extend in radial relation to the cylinder 5*a* (or fins 5*b*) for introducing the ink into an ink-reserving slot 8.

Furthermore, on both sides of the openings of the ink introducing slots 9, the respective fins are integrally formed with protruding sections 10 and 11 to cause the width(gaps between respective two adjacent fins 5*b* and 5*b*) of the ink reserving slots to be smaller in part. Thereby, as shown in FIG. 1(*b*), of the distances between respective two adjacent fins 5*b* and 5*b*, a measurement A between a top of each protruding section 10 or 11 in one of the fins 5*b* and an axial end of the other fin 5*b* is smaller than the measurement B between the two fins 5*b* and 5*b* at other sections.

Where the collector is constituted in the manner as stated above, the ink overflowing by the rise of pressure in the ink cartridge 6, is introduced from the ink guide 4 through the ink introducing slots 9 of each fins 5*b* into each ink-reserving slot 8. It is to be noted here that since the width of the ink reserving slots 8 at both protruding sections 10 and 11 are set less than the width of the ink-reserving slots 8 of other sections, a greater capillary power is realized to such an extent that the delivery response of the ink is improved.

In addition, in this embodiment, since only part of the width of the ink-reserving slots 8 becomes less, it will inhibit the required rigidity of the mold for producing the collector from being lost.

Furthermore, in this embodiment, since only part of the width of the ink-reserving slots 8 becomes less, the depth of the ink-reserving slots 8 may be maintained at a large level such that the capacity of the ink-reserving slots 8 will not be smaller.

Next, the second embodiment in accordance with the present invention will be described hereinafter in detail with reference to FIG. 2, FIG. 3(*a*) and FIG. 3(*b*).

Figure 3:
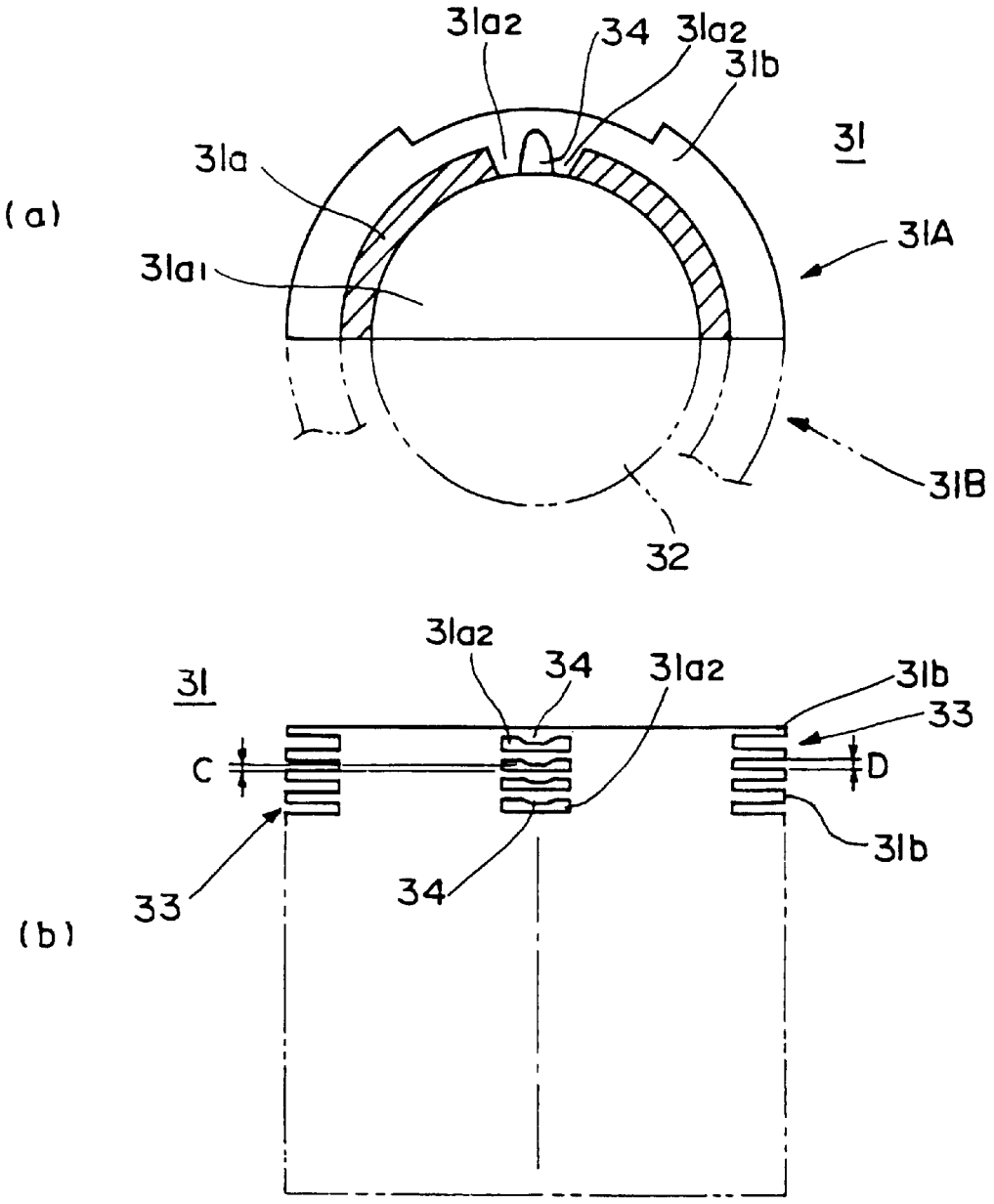
FIG. 3(*a*) and FIG. 3(*b*) are a cross-sectional view and a front view of a principal part of a collector in accordance with a second embodiment of the present invention.

FIGS. 3(*a*) and 3(*b*) are a cross-sectional view and a front view of a principal part of a liquid application reservoir (collector) in accordance with the second embodiment of the present invention.

In FIGS. 3(*a*) and 3(*b*), a collector numbered as 31 is provided in the form of an ink reservoir, like the collector 5 in the first embodiment to reserve the ink in the vicinity of the ink guide 32, said collector being accommodated inside the container body 2*a* and located between the container lid 7(on the pen core side of the peripheral margin of the opening of the bore 7*a*) and the inner peripheral margin of the opening of the bore 2*a*1. Said collector 31 is comprised of a cylinder 31*a* and a plurality of fins 31*b* provided thereon. Further, the whole structure is comprised of two reservoir elements 31A and 31B, each element having the form of a collector divided along a cross section containing therein an axis line of the inner hole(will be stated hereinafter) and formed of synthetic resins, such as an ABS resin.

The cylinder 31*a* comprised of each reservoir elements 31A and 31B is located on axis of the ink guide 4. The cylinder 31*a* is formed with an inner hole 31*a*1, which opens at both axial ends thereof to allow the ink guide 4 to be inserted therethrough. Furthermore, cylinder 31*a* is formed with a plurality of ink flow in/out ports 31*a*2, in communication with the inner hole 31*a*1 and an ink reserving slots(to be stated hereinafter). The respective ink flow in/out ports 31*a*2 are provided in the form of opening sections progressively expanding from inside to outside of the cylinder and are arranged at the predetermined axial and circumferential intervals on the cylinder 31*a* (especially at the circumferential interval of 180 degrees).

Said fins 31*b* are provided in the form of plural annular pieces that stand parallel to each other and perpendicular to the axial direction at predetermined intervals therebetween, each fin being formed integrally to said cylinder 31*a* to extend radially outwardly therefrom. In these fins 31*b*, spaces are defined between the respective adjacent two fins 31*b* and 31*b* which serve as annular ink reserving slots 33 having substantially an identical width to the respective ink flow in/out ports 31*a*2 in an axial direction(maximum size) and extending around the cylinder 31*a*.

In addition, the respective fins 31*b* are formed with protruding sections 34, thereon which serve to block part of the ink flow in/out ports 31*a*2 such that the ink reserving slots 33 becomes narrower in part. Thereby, as shown in FIG. 3(*b*), of the respective adjacent two fins 31*b* and 31*b*, a gap C between the top of each respective protruding section 34 on one of the fins 31*b* and the axial ends of the other fins 31*b* (or the wall of the ink reserving slots 8) become narrower than the gap D between two fins 31*b* and 31*b*.

In the collector thus constituted, the ink inside the ink cartridge 6 is introduced into the ink guide 4, the ink flow in/out ports 31*a*2 and the ink-reserving slots 33, in this order. It is to be noted here that the ink reserving slots 33 is set narrower at the protruding sections 34 than at the other sections such that a greater capillary power is realized with the result that the delivery response of the ink is improved.

Furthermore, since the ink-reserving slots 33 becomes narrower only in part in this embodiment, it prevents the required rigidity of the mold for making the collector from being lost and it is possible to design deeper ink reserving slots 33, thus maintaining the capacity thereof.

Furthermore, in each embodiment, although the constitution in which all of the ink-reserving slots become narrower only in part is described, the present invention is not limited to the constitution described above and it may be constituted in a manner where the ink-reserving slots on the cartridge side becomes narrower.

In the manner described above, the ink is reserved in the ink-reserving slots on the cartridge side under the influence of the capillary power, and on the other hand, the ink is reserved in the ink-reserving slots on the non-cartridge side under the influence of its own weight with the result that the ink is uniformly reserved in all of the ink-reserving slots.

Moreover, in the respective embodiments, the present invention has been explained as being applied to the writing implements though the present invention is not limited thereto but can be applied to application implements like a makeup liquid applicator or printing equipments such as an ink jet record equipment in a same manner as the embodiments described above. Especially, in the printing equipments such as the ink jet record equipment, the use of the application liquid reservoir(collector) of the present invention between the ink cartridge and a recording head (a head which supplies the ink) prevents undesirable drippings of the ink.

In above description of the present invention, the designing of a sufficient depth of the application liquid reserving slots has become possible because the ink-reserving slots are set to be narrower in part.

Therefore, it is able to prevent the required rigidity of the mold from being lost and to increase the inner capacity of the application liquid reserving slots, thus enabling to produce articles of excellent quality, to hold a sufficient quantity of the application liquid in the application liquid reserving slots and to improve the delivery response of the application liquid.

What claimed is:

1. An application liquid reservoir for reserving application liquid located in the vicinity of an application liquid guide interposed between an application liquid cartridge and an applicator, said application liquid reservoir comprising a cylinder having an inner hole to receive an ink guide therein, and fin means extending radially outwardly from said cylinder, said fin means including a plurality of fins that stand parallel to each other and perpendicular to an axial direction of the said inner hole at a predetermined interval to define annular application liquid reserving slots between adjacent two said fins, said respective application liquid reserving slots being set to be narrower in part, the parts of said application liquid reserving slots that are narrower in part extending away from said cylinder toward outer edges of said plurality of fins.

2. An application liquid reservoir according to claim 1, wherein said respective fins of the said application reservoir are formed with notches to define application liquid introduction slots adapted to introduce the application liquid into the said application reserving slots.

3. An application liquid reservoir according to claim 2, wherein the respective fins are formed with protruding sections on both sides of said application liquid introduction slots such that said application liquid reserving slots becomes narrower in part.

4. An application liquid reservoir for reserving application liquid located in the vicinity of an application liquid guide interposed between an application liquid cartridge and an applicator, said application liquid reservoir comprising a cylinder having an inner hole to receive an ink guide therein, and fin means extending radially outwardly from said cylinder, said fin means including a plurality of fins that stand parallel to each other and perpendicular to an axial direction of the said inner hole at a predetermined interval to define annular application liquid reserving slots between adjacent two said fins, said respective application liquid reserving slots being set to be narrower in part, wherein said cylinder is formed with liquid flow in/out ports in communication with the said inner hole and said application liquid reserving slots;

wherein said application liquid reservoir is composed of two reservoir elements, each element having the form of an application liquid reservoir divided along a cross section containing the axis of said inner hole; and wherein said liquid flow in/out ports are formed in places other than the places where said two reservoir elements are engaged.

5. An application liquid reservoir for reserving application liquid located in the vicinity of an application liquid guide interposed between an application liquid cartridge and an applicator, said application liquid reservoir comprising a cylinder having an inner hole to receive an ink guide therein, and fin means extending radially outwardly from said cylinder, said fin means including a plurality of fins that stand parallel to each other and perpendicular to an axial direction of the said inner hole at a predetermined interval to define annular application liquid reserving slots between adjacent two said fins, said respective application liquid reserving slots being set to be narrower in part, wherein said cylinder is formed with liquid flow in/out ports in communication with the said inner hole and said application liquid reserving slots, and wherein respective said fins are provided with protruding sections to block said application liquid flow in/out ports in part such that the application liquid reserving slots become narrower in part.

6. An application liquid reservoir according to claim 5, wherein said application liquid reservoir is composed of two reservoir elements, each element having the form of an application liquid reservoir divided along a cross section containing the axis of said inner hole.

7. An application liquid reservoir according to claim 6, wherein said liquid flow in/out ports are formed in places other than the places where said two reservoir elements are engaged.

8. An application liquid reservoir for reserving the application liquid located in the vicinity of an application liquid guide interposed between application liquid cartridge and an applicator, said application liquid reservoir comprising a cylinder having an inner hole to receive an ink guide therein, and fin means extending radially outwardly from said cylinder, said fin means including a plurality of fins that stand parallel to each other and perpendicular to an axial direction of the said inner hole at a predetermined interval to define annular application liquid reserving slots, having openings with margins, between said adjacent two fins, said respective application liquid reserving slots being set to be narrower in part, wherein said respective fins of the said application reservoir are formed with notches to define application liquid introduction slots adapted to introduce the application liquid into the said application reserving slots, and wherein the respective fins are formed with protruding sections on both sides of the openings at the margins of said application liquid introduction slots such that said application liquid reserving slots becomes narrower in part.

9. An application liquid reservoir according to claim 8, wherein said application liquid reservoir is composed of two reservoir elements, each element having the form of an application liquid reservoir divided along a cross section containing the axis of the said inner hole.

* * * * *